US006622735B2

(12) United States Patent
Hirata et al.

(10) Patent No.: US 6,622,735 B2
(45) Date of Patent: Sep. 23, 2003

(54) HAIR IRON EQUIPPED WITH IRON PRESS COVER

(75) Inventors: Yoshihiro Hirata, Kyoto (JP); Yuko Yamashita, Tokyo (JP)

(73) Assignee: Phild Co., Ltd., Kyoto (JP)

( * ) Notice: Subject to any disclaimer, the term of this patent is extended or adjusted under 35 U.S.C. 154(b) by 15 days.

(21) Appl. No.: 09/885,711

(22) Filed: Jun. 20, 2001

(65) Prior Publication Data

US 2002/0036000 A1 Mar. 28, 2002

(30) Foreign Application Priority Data

Oct. 25, 2000 (JP) ..... 2000-324847
Jun. 26, 2000 (JP) ..... 2000-190463

(51) Int. Cl.[7] ..... A45D 1/00; A45D 7/02
(52) U.S. Cl. ..... 132/224; 132/269; 132/212
(58) Field of Search ..... 132/224, 225, 132/269, 212; 219/225, 227, 228, 229

(56) References Cited

U.S. PATENT DOCUMENTS 2,776,667 A * 1/1957 Fitz Gerald ..... 132/212
4,236,540 A 12/1980 Takagi et al.
4,242,567 A * 12/1980 Carter ..... 219/225
4,576,188 A 3/1986 Barradas
5,664,588 A 9/1997 Berry
5,848,599 A * 12/1998 Todd ..... 132/221
6,191,387 B1 * 2/2001 Smal ..... 219/225

FOREIGN PATENT DOCUMENTS

GB 2 167 953 A 6/1986
WO WO 00 15070 A 3/2000

* cited by examiner

*Primary Examiner*—John J. Wilson
*Assistant Examiner*—Robyn Kieu Doan
(74) *Attorney, Agent, or Firm*—Knobbe, Martens, Olson & Bear LLP

(57) ABSTRACT

An improved hair iron prevents damage to and frizziness of hair. A hair heating surface and a pressing surface of an iron for hair treatment are covered with iron press covers made from a woven or nonwoven cloth of a heat-resistant synthetic fiber.

11 Claims, 4 Drawing Sheets

FIG. 7
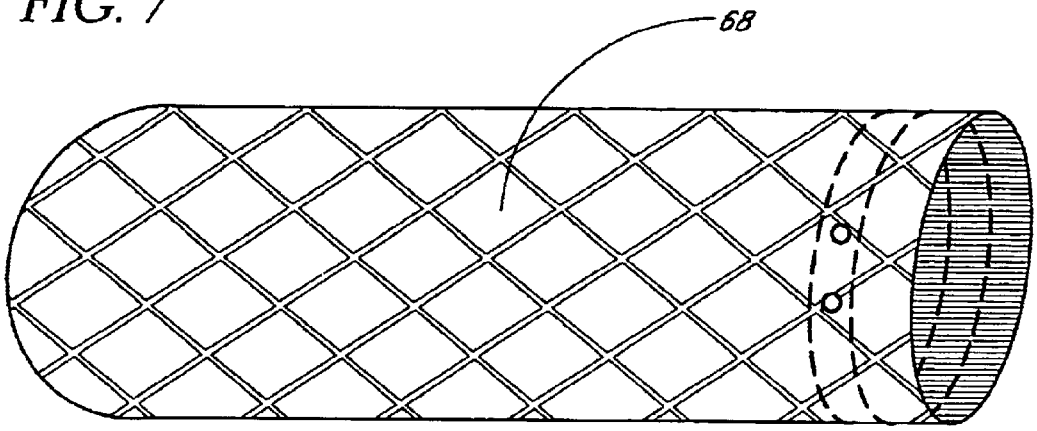
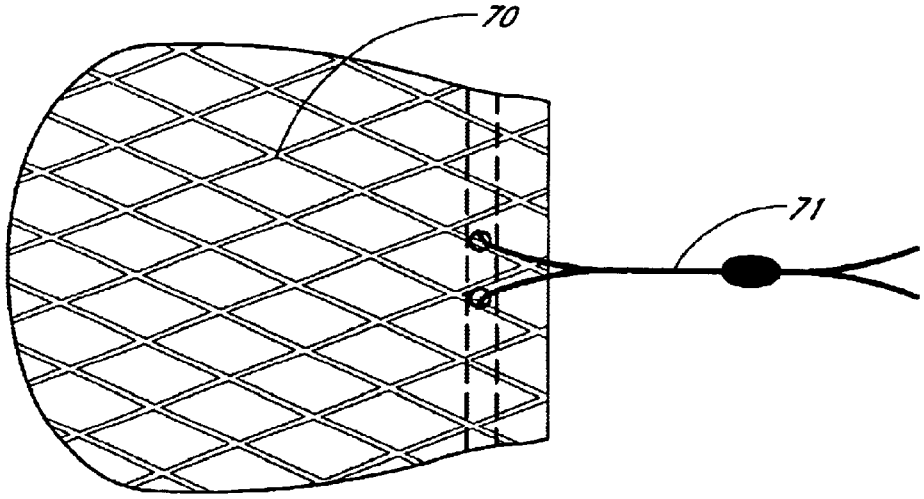
FIG. 8

HAIR IRON EQUIPPED WITH IRON PRESS COVER

FIELD OF THE INVENTION

The present invention relates to an improvement of a hair iron for hairstyling by a finger operation.

The present invention also relates to a removable cylindrical iron press cover to cover a heating surface and a pressing surface of a hair iron for hair treatment.

DESCRIPTION OF THE PRIOR ART

Hairstyling has been always been an important factor for females for a decent or attractive appearance. Today, hair irons are conveniently and widely used not only by hairstyling professionals but also by women at home as a tool for simple hair setting or hairstyling.

There are different types of hair, i.e., straight hair, frizzy hair, curly hair, and the like. In general, in order to attain a desired hairstyle, for example, straight hair is set with curls or curly hair is straightened. Easy hairstyling using hair irons is now possible instead of having to use chemicals for a perm. Thus, a demand for hair iron products has steadily increased as a reflection of consumers' aesthetic tastes.

Furthermore, in recent years, the trend in hair coloring is towards drastic coloring and bleaching, and razors and scissors are more frequently used to make the cut end of hair (filter) wider in an attempt to attain an impressive hairstyle. While the use of these various hair setting techniques has become wide spread, hair damage caused by drastic hairstyling and erroneous home haircare such as excessive hair washings has become a serious problem. Thus, there is a strong demand for development of methods for hair setting without causing damage to the hair.

Technology in hair irons relates mostly to an improvement of their functions and safety, including a hair iron which consists of a hair scrolling body formed from a heat conducting material and a hair guide formed with a non-heat conducting material to protect a user from bum and heat (Japanese Patent Application Laid-open No. H11-127941), a hair iron in which slits are formed on an ironing member and heaters insulated by ceramic are interiorly mounted on both sides of the slits, which permits the moisture going in and out, in order to improve hairstyling efficiency (Japanese Patent Application Laid-open No. H11-75927), an hair iron in which a steam opening and a steam leak preventing wall are formed in the hollow part of a corrugated heating plate in order to protect the scalp and fingers from leaking steam in hairstyling with steam (Japanese Patent Application Laid-open No. H10-272012), an electric iron in which a fluorine resin coating is applied on an ironing member to generate anions to prevent hair damage and shorten the time for the curling process (Registered Japanese Utility Model No. 3047352), a hair iron in which a space is formed in a partial site of oppositionally facing curved surfaces of a rod and a glove to improve aesthetic finishing with lustrous hair (Japanese Utility Model Application Laid-open No. H06-72501), and a hair iron in which the surfaces of oppositionally facing hair pressing parts are formed as engaging concave and convex surfaces and heaters are built inside said pressing parts to straighten frizzy hair into lustrous smooth straight hair without causing damage (Japanese Patent Application Laid-open No. H06-189818).

However, in the abovementioned prior art, the handiness and efficiency of hair irons remain unsatisfactory, although their safety, hairstyling functions, artistic finishing, or other functions have been gradually improved.

The present inventors worked intensively to improve the handiness and efficiency of hair irons, invented a castanet-like hair iron which is different from a conventional arm-type hair iron in its handiness, and applied for a patent (Japanese Patent Application Laid-open No. H10-296007) prior to the present application. As shown in the perspective view in FIG. 2, the hair iron 11 of this previous application comprises holding members 14 and 15 which are joined via a joint member (not shown) and have a hair heating surface 12 and a pressing surface 13 thereon, and a cord 16 connectable to a source of electrical power. This novel iron can be freely opened and closed by the pressing force of the palm and fingers straddling the joint member so that the hair iron can be operated like a castanet. Since a bundle of hair is sandwiched between the holding members and the heating surface and the pressing surface are pressed directly with fingers, the pressing force is easily controlled so that even females having a weak grip can easily operate the iron. Thus, the heating surface can be more accurately, delicately and easily controlled as compared with the prior art arm-like irons, which permits a flexible, desired hair ironing operation.

In conventional hair irons, the ironing surface in contact with the hair is hot and noncompliant, and the entire periphery of a hair is not in contact with the ironing surface. As a result, such irons used without any modification would cause frizziness in hair already damaged in the middle or at the ends. This is because about 99% of hair is comprised of proteins, and said proteins are decomposed by the use of alkaline chemicals for hair treatments, such as perm agents and hair coloring agents. As a result, hair is softened by the alkaline chemicals and loses its strength, becoming susceptible to damage. Hair is roughly divided into three parts, i.e., a newly grown part which has never been in contact with perm agents or coloring agents, a middle part which has been treated with perm agents or coloring agents, and an end part which has been damaged by multiple treatments with perm agents and coloring agents. Generally, the extent of damage is increases from the newly grown to the middle part to the end part. At the end part, split hairs may occur at the tip.

In the abovementioned hair irons, handiness and efficiency has been improved. However, it was very difficult to control the heating temperature so as not to decompose the hair components and so as not to cause damage to the hair while heating since the heating element of the hair irons is metallic and the hair is held in direct contact with the metallic heating element.

Meantime, a hair iron was disclosed in which the outer surface of a conductive heating body and the surface of a clamp are flocked and the hair is held in between to minimize the damage to the hair by heating (U.S. Pat. No. 4,477,716). However, flocking with a nonhygroscopic material had little covering effect on the heating surface and the flocking was semipermanent so that a troublesome reflocking was required. Furthermore, the flocking absorbed and accumulated odors resulting from decomposition of hair treating agents by heat, and this odor was released during an ironing operation with heat, which prevented the long term use of the flocked hair iron.

SUMMARY OF THE INVENTION

Accordingly, in an attempt to improve hair irons from a functional point of view for aesthetic finishing, an object of the present invention is to provide a hair iron equipped with an easily-removable, non-baggy iron press cover, which permits safe and accurate ironing, minimizes further damage and frizziness to hair having been damaged or split at the tips after repeated treatments with perm agents and ironing treatments, and prevents generation of an odor over a long period of time.

In the present invention, a removable iron press cover covers a heating surface and a pressing surface of the hair iron area where the hair is brought into contact, so that hair is not in direct contact with the heating surface of the iron, but the entire periphery of the hair is in contact with said heating surface. In this way, frizziness of the middle and end parts of the hair which have been damaged or split can be prevented. Further, the cover can be appropriately washed to keep it clean so that the hair iron can be used comfortably without sensing odor generated by heating.

According to the present invention, covering the heating surface of the iron enables hair to be in indirect contact, a so-called "surface contact" with the metal heating surface of the iron, and avoids hair from having direct contact, a so-called "linear contact," with the heating surface so that the hair can be treated without causing frizziness even to damaged or split hair.

Furthermore, the iron press cover of the present invention can contain a component which generates a fragrance upon heating for a more comfortable use.

The present invention is fundamentally composed of the following configurations.

(1) In an arm-type hair iron in which a pair of arm members having a hair heating surface and a pressing surface oppositionally on their interior surfaces are joined at their ends via a joint member and can be flexibly opened and closed; removable, heat-resistant iron press covers to cover said hair heating surface and the pressing surface.

(2) In a castanet-like hair iron in which a pair of holding members having a hair heating surface and a pressing surface oppositionally on their interior surfaces are joined via a joint member and flexibly opened and closed by the force of the palm and fingers which straddle said joint member; removable, heat-resistant iron press covers to cover said hair heating surface and the pressing surface.

(3) Removable, heat-resistant iron press covers as described in (1) or (2) above, wherein the removable woven or non-woven cloth covers are cylindrical.

(4) Removable, heat-resistant iron press covers as described in (1), (2) or (3) above, characterized in that they completely cover the end of said arm members or holding members.

(5) Removable, heat-resistant iron press covers as described in any one of (1) through (4) above, wherein the removable woven or non-woven cloth covers are tightened at a switch part and are free from slippage and looseness.

(6) Removable, heat-resistant iron press covers as described in any one of (1) through (5) above, wherein the removable woven or non-woven cloth covers are appropriately colored in those parts which cover the top and bottom and/or the heating surface and the interior and/or exterior of the pressing surface of the iron for a quick identification upon use.

(7) Removable, heat-resistant iron press covers as described in any one of (1) through (6) above, wherein the removable woven or non-woven cloth covers can control the heating effect of ironing by a variation in thickness and can be exchangeable depending on the extent of damage to the hair.

(8) Removable, heat-resistant iron press covers as described in any one of (1) through (7) above, wherein the removable woven or non-woven cloth covers contain a fragrance which can be decomposed at high temperatures.

(9) Removable heat-resistant iron press covers as described in any one of (1) through (8) above, which can be washed for sanitary maintenance.

BRIEF DESCRIPTION OF THE DRAWINGS

[FIG. 7] A perspective view of the iron press cover for the arm-type hair iron]

[FIG. 8] A planar view of the iron press cover for the castanet-like hair iron.

Explanation of Symbols

Figure 1:
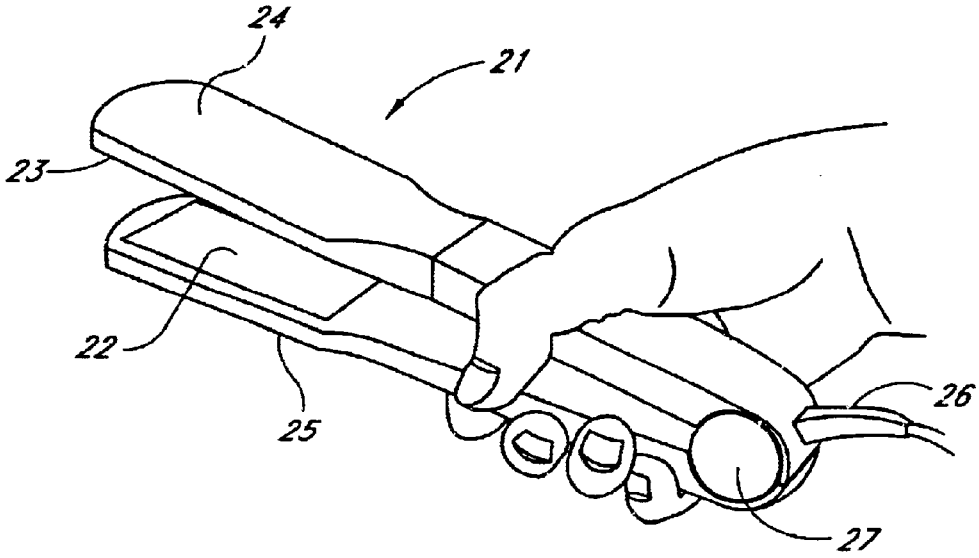
[FIG. 1] A perspective view of the conventional arm-type hair iron.

11 Castanet-like hair iron
12 Heating surface
13 Pressing surface
14,15 Holding members
16 Cord for the power source
21 Arm-type hair iron
22 Heating surface
23 Pressing surface
24,25 Arm members
26 Cord for the power source
27 Joint member
31 Hair cross-section
32 Iron cross-section (pressing surface)
33 Iron cross-section (heating surface)
41 Iron cross-section (pressing surface)
42 Iron press cover
43 Hair cross-section
44 Iron cross-section (heating surface)
61 Arm member
68 Iron press cover (for arm-type hair iron)
69 Tightening opening
70 Iron press cover (for castanet-like hair iron)
71 Tightening opening
72 Holding member

DETAILED DESCRIPTION OF THE INVENTION

Embodiments of the present invention will be explained more in detail referring to drawings and examples along with comparative examples. However, the present invention is not limited to these examples.

Figure 2:
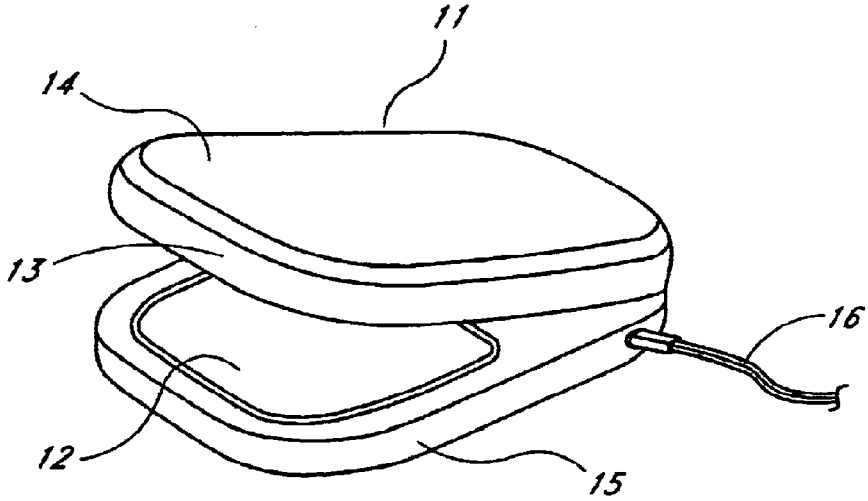
[FIG. 2] A perspective view of the castanet-like hair iron of the invention prior to the present application.
Figure 3:
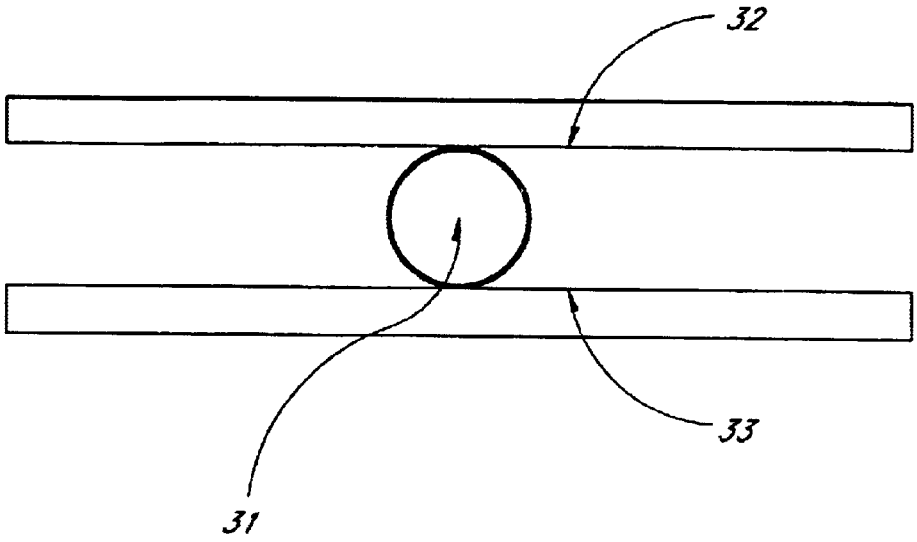
[FIG. 3] A cross-sectional view of the conventional hair iron in an ironing operation.
Figure 4:
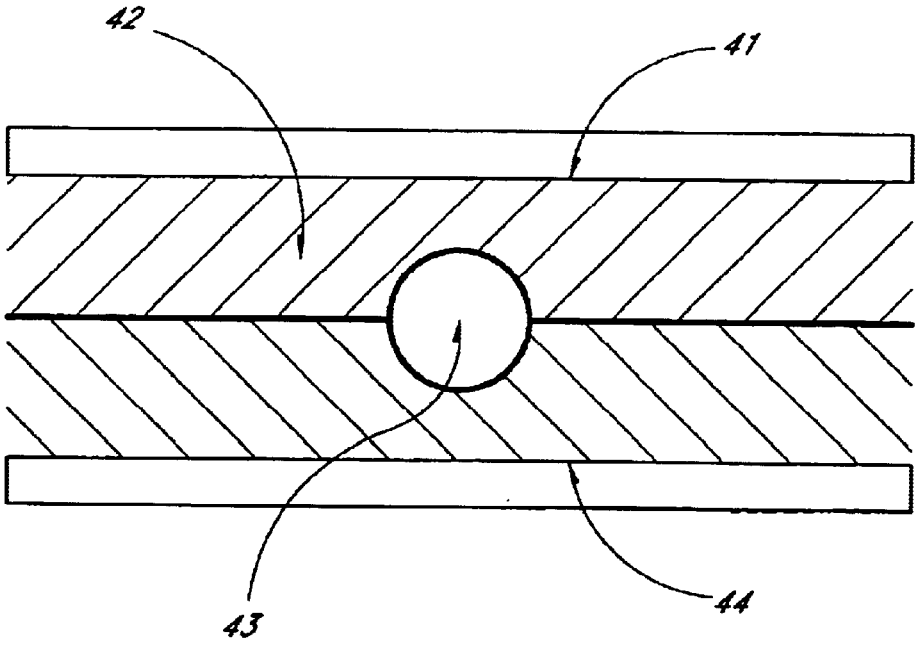
[FIG. 4] A cross-sectional view of the hair iron of the present invention in an ironing operation.
Figure 5:
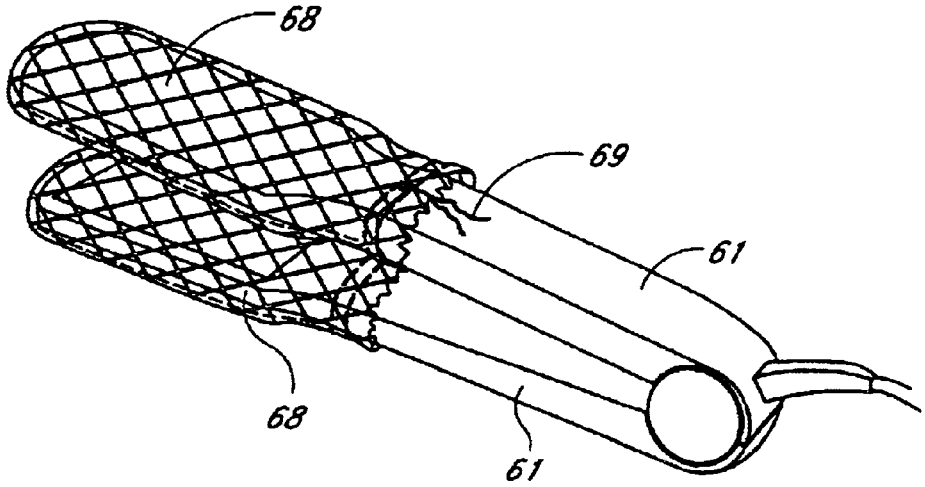
[FIG. 5] An illustration of the iron press covers in use for the arm-type hair iron.
Figure 6:
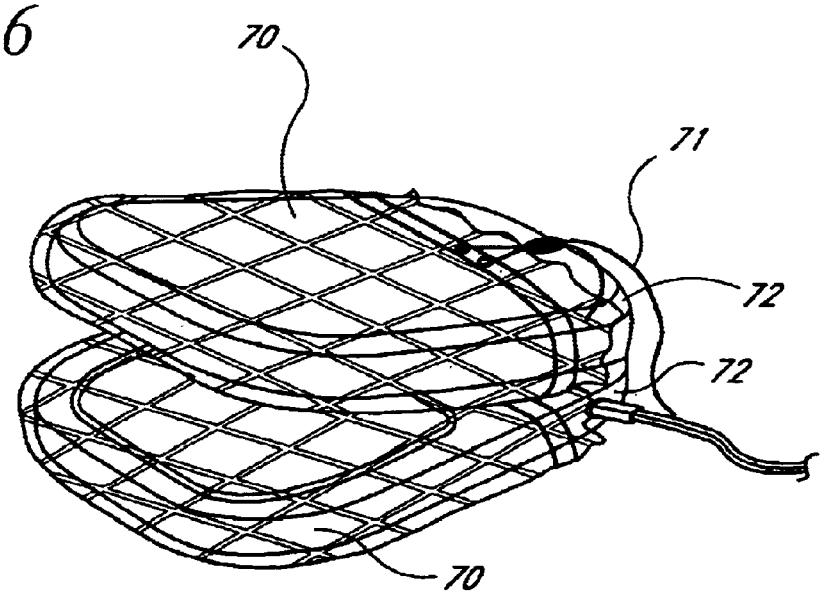
[FIG. 6] An illustration of the iron press covers in use for the castanet-like hair iron.

FIG. 1 is a perspective view of the conventional arm-type hair iron, FIG. 2 is a perspective view of the castanet-like hair iron of the invention prior to the present application, FIG. 3 is a cross-sectional view of the conventional hair iron in an ironing operation, FIG. 4 is a cross-sectional view of the hair iron of the present invention in an ironing operation, FIG. 5 illustrates the iron press covers in use for the arm-type hair iron, FIG. 6 illustrates the iron press covers in use for the castanet-like hair iron, FIG. 7 is a perspective view of the iron press cover for the arm-type hair iron, and FIG. 8 is a planar view of the iron press cover for the castanet-like hair iron.

A general arm-type hair iron is shown in FIG. 1, in which the hair iron comprises arm members 24 and 25 which are joined via a joint member 27 and have a hair heating surface 22 and a pressing surface 23 thereon, and a cord 26 connectable to a source of electrical power. In this iron, the arm members can be freely opened and closed by the gripping force of fingers, and the hair can be ironed by sandwiching a bundle of hair between the arm members and pressing the heating surface and the pressing surface together with the fingers. In such an arm-type hair iron, as shown in FIG. 3, a hair cross-section 31 is sandwiched between the hair heating surface 33 and the pressing surface 32 so that the hair is held in contact only "linearly" with the top and bottom heated, noncompliant surfaces. Thus, the hair is held in contact with the heating surface only at the point of contact, which generates a difference in temperature and water content between this area with contact and the area without contact. Furthermore, the hair is pressed only at the point of contact so that a hair section is distorted and heated while fixed in an irregular configuration, which causes frizziness and further damage. In particular, the degree of frizziness increases if the hair is damaged in the middle part or split at the ends as a result of treatment with perm agents or coloring agents. Such damage or split ends may trigger the frizziness.

Accordingly, a hair iron has been invented in which the outer side of a heat conductive heating body and the surface of a clamp are flocked, and the hair is held in between the two flocked surfaces to minimize damage to the hair upon heating (U.S. Pat. No. 4,477,716). However, flocking has little effect as covering on the heating surface and the flocking process is troublesome. Furthermore, the flocking absorbs and accumulates odors resulting from decomposition of hair treating agents by heat, and the odor is generated during ironing, which prevents the long term use of a flocked hair iron.

Therefore, in the present invention, as shown in a cross-sectional view of the hair in FIG. 4, a strand of hair is in contact "in totality" with the hair heating surface. Namely, the section 43 of the hair is sandwiched between the hair heating surface 44 and the pressing surface 41 so that the hair is held in contact not directly but via an iron press cover 42 consisting of a heat-resistant synthetic fiber with the top and bottom heated, noncompliant surfaces, so that the entire periphery of the hair is gently wrapped by the synthetic fiber. Thus, in contrast to the abovementioned conventional hair irons, the entire periphery of the hair is held in the same environment and the heat is evenly dispersed by the synthetic fiber, which prevents a difference in temperature and water content from arising in the section of the hair. Furthermore, the hair is pressed not only at the point of contact but also evenly on the entire periphery so that the hair cross-section is not distorted and the hair is not heated while fixed in an irregular configuration. Further, since the entire periphery of the hair is gently wrapped by the synthetic fiber, pressing is carried out indirectly, which generally results in effectively preventing frizziness and further damage. In particular, the heating treatment can be more effective by having heating surfaces on both sides of the iron and applying heat from the top and bottom surfaces.

The iron press cover has an appropriate elasticity and thickness, and is made of a heat-resistant synthetic fiber. This removable, cylindrical hair iron press covers wrap around the hair contacting area of the heating surface and the pressing surface of the hair iron. The cover can be secured by tightening a string of the cover at the switch site like a drawing purse. The thickness of the cover is preferably about 0.1–5 mm and depends on the extent of damage of the hair. More preferably the thickness is about 0.2–1 mm for healthy hair and about 3–5 mm for damaged hair. Heating treatment can be controlled by appropriately changing the cover of different thickness instead of finely setting the iron temperature, which permits simple and quick pressing operation. The kind of heat-resistant synthetic fiber is not limited and common fibers such as polyester fibers and polyamide fibers can be used. Since the temperature of the heating surface reaches more than 100C, highly heat resistant woven or nonwoven fibers such as aramid fibers, fluorinated polyethylene fibers and polybenzimidazole fibers can be used.

The iron press cover can be more comfortably used by using chemicals which generate a fragrance upon heating, for example aromatic agents decomposable by high temperatures, such as bomeol, maltol, musk xylene, and musk ketone.

However, odor due to the use of hair treatment agents or from the hair itself is generated after dozens of use of such iron press covers. This odor generated upon heating the iron can be prevented by washing the cover after about every 10 uses, depending on the conditions of usage, to maintain its sanitariness.

Furthermore, the cover can be appropriately colored in parts which cover the top and bottom and/or the interior and/or exterior of the heating surface and the pressing surface of the iron for a quick identification upon use and for an efficient fitting.

Upon the use of a hair iron of the present invention, a bundle of hair having damaged portions is sandwiched between the heating surfaces at about 180C and pressed while heating for about 2–3 seconds, and the pressing force is released to slide the ironing surface to the tip of the hair. After repeating this operation 2–3 times, the hair is dried and the ironing is completed.

When used for hair on which a treatment agent is applied, the steam inside the hair is maintained inside the iron cover so that the treatment can be performed more effectively and at a higher temperature as compared to an ordinary steamer-type treatment (40–60C).

Portions of already damaged hair can be further damaged when hair is softened and pressed down between metal surfaces, in particular when the hair is moist. The iron press cover of the present invention absorbs the applied pressure so that the pressure on the hair is lighter as compared to the pressure caused by the same gripping force applied on an iron without the cover. Thus damage to the softened hair can be prevented.

Furthermore, the use of a conventional hair iron without applying excessive force at a temperature of the ironing surface of 40–50C to prevent damage to the hair requires skill and setting the temperature of the ironing surface is time-consuming, which makes the iron unsuitable for use by general consumers.

In contrast, anyone, not necessarily a skilled professional, can perform hairstyling easily and in a short time without causing damage to the hair by choosing appropriate iron press covers of the present invention according to hair characteristics and the extent of the damage.

Furthermore, the iron press covers on the hair heating surface and the pressing surface are similarly effective with the castanet-like hair iron of the invention prior to the present invention, shown in FIG. 2. In this castanet-like hair iron 11, holding members 14 and 15 having a hair heating surface 12 and a pressing surface 13 are joined via a joint member (not shown), a cord 16 connects to the power source, and the holding members are flexibly opened and closed like a castanet by the pressing force of the palm and fingers which straddle said joint member. Thus, a bundle of hair can be sandwiched between the holding members and ironed by directly pressing the heating surface and the pressing surface with fingers.

As shown in FIG. 7 and FIG. 8, the woven or non-woven iron press cover is formed to be cylindrical to wrap around the heating surface and the pressing surface of the iron so that the heat of the heating surface reaches the entire periphery of the hair through the cover, which increases the heating efficiency of the heating surface during the hair treatment.

FIG. 5 shows an arm-type hair iron wrapped with a pair of the iron press covers of the present invention. The ends of arm members 61 are inserted into the iron press covers 68 and tied at the tightening openings to wrap the covers around the arm members 61 so that the heat of the iron reaches the entire periphery of the hair through the covers and an easier and safer pressing can be performed. Further, tightening the tightening openings 69 prevents the covers from becoming loose and slipping, which permits a smooth ironing operation.

FIG. 6 shows a castanet-like hair iron wrapped with a pair of the iron press covers of the present invention. The holding members 72 are inserted into the iron press covers and tightened at the tightening openings 71 to wrap the cover around the holding members so that the heat of the iron reaches the entire periphery of the hair through the covers and an easier and safer pressing can be performed. Further, tightening the tightening openings 71 prevents the cover from becoming loose and slipping, which permits a smooth ironing operation.

Furthermore, the iron press cover can be appropriately colored in those parts which cover the top and bottom and the interior and exterior of the heating and pressing surfaces of the iron for a quick identification upon use and an efficient fitting.

The followings are Examples 1 and 2 and Comparative Examples 1 and 2.

EXAMPLE 1

Iron covers were made using a cylindrical covering material formed from a commercially available meta-aramid woven fiber. Hair irons firmly wrapped with these covers on their holding members were actually used to treat 5 adult female monitors (3 with straight hair and 2 with curling hair). Hair was roughly divided into three parts, i.e., a new hair portion which had never been treated with perm agents or coloring agents, a middle portion which had been treated with perm agents or coloring agents, and an end portion which had severe damage caused by multiple treatments with perm agents or coloring agents.

Results are shown in Table 1.

The covers of the present invention to cover the hair irons were changed after every 10 uses.

EXAMPLE 2

Iron covers were made using a covering material formed from a commercially available polyester woven fiber. The covers were applied on hair irons and ironing was carried out in the same manner as described in Example 1.

COMPARATIVE EXAMPLES 1 AND 2

Ironing was carried out in the same manner as described in Examples 1 and 2, except that the iron covers were not used.

Evaluation of Function of the Hair Irons

Results of evaluation in Examples 1 and 2 and Comparative Examples 1 and 2 were shown in Table 1.

TABLE 1

| | Handiness | Aesthetic finishing | Frizziness | Odor |
|---|---|---|---|---|
| Example 1 | ○ | ○○ | ○○ | Not sensed |
| Example 2 | ○○ | ○○ | ○○ | Not sensed |
| Comparative Example 1 | Δ | ▼ | x | |
| Comparative Example 2 | ○○ | ○ | ▼ | |

(Handiness) ○○: Very good, ○: Good, Δ: Average
(Artistic finishing) ○○: Very good, ○: Good, ▼: Slightly poor
(Frizziness) ○○: None, ▼: Slightly seen, x: Fairly seen As shown in the results of monitoring above, the iron press covers of the present invention gave sufficient satisfaction to the users in all terms, i.e., handiness, aesthetic finishing and frizziness. On the other hand, when conventional hair irons were used without using the iron press covers of the present invention (Comparative Example 1), the users were not satisfied with the ironing in any terms, i.e., handiness, aesthetic finishing or frizziness. When castanet-type hair irons were used without using the iron press covers of the present invention (Comparative Example 2), the users were satisfied in terms of handiness and aesthetic finishing, but not in terms of frizziness.

By using the iron press cover of the present invention, hair ironing can be performed without causing frizziness and further damage to hair already severely damaged or with split ends caused by hair coloring, cutting, or perms. Furthermore, the iron press cover of the present invention is removable through a tightening opening so that it can be washed and exchangeable at appropriate intervals to maintain the sanitariness of the cover for comfortable use of the hair iron. Furthermore, the iron press cover can contain a fragrant agent for a further comfortable use.

What is claimed is:

1. A hair iron, comprising:

a first member having a hair heating surface on an interior surface thereof a second member having a pressing surface on an interior surface thereof, said first and second members joined at their ends via a joint member such that the members can be flexibly opened and closed to bring said hair heating surface and said pressing surface into and out of opposition;

a first removable, heat-resistant iron press cover to cover said hair heating surface; and a second removable, heat-resistant iron press cover to cover said pressing surface, wherein the press covers are comprised of woven or non-woven cloth made of polyester fibers, polyamide fibers, fluorinated polyethylene fibers, or polybenzimidazole fibers.

2. The hair iron of claim 1, wherein the hair iron is a castanet-like hair iron and the first and second members are holding members.

3. The hair iron of claim 1, wherein the hair iron is an arm-type hair iron and the first and second members are arm members.

4. The hair iron of claim 1, wherein the press covers are cylindrical.

5. The hair iron of claim 1, wherein the press covers are tightened at a switch part and are free from slippage and looseness.

6. The hair iron of claim 1, wherein the press covers are appropriately colored in those parts which cover the top and bottom and/or the heating surface and the interior and/or exterior of the pressing surface of the iron for quick identification.

7. A method of styling hair using the hair iron of claim 1, comprising placing said hair between the first and second heating surfaces and bringing said first and second surfaces into opposition, thereby sandwiching said hair between the hair heating surface and the pressing surface via said iron press covers.

8.The method of claim 7, additionally comprising selecting the iron press covers of an appropriate thickness so as to control the heating effect of ironing depending on the extent of damage to the hair.

9. A hair iron, comprising:

a first member having a hair heating surface on an interior surface thereof a second member having a pressing surface on an interior surface thereof, said first and second members joined at their ends via a joint member such that the members can be flexibly opened and closed to bring said hair heating surface and said pressing surface into and out of opposition;

a first removable, heat-resistant iron press cover to cover said hair heating surface; and a second removable, heat-resistant iron press cover to cover said pressing surface, wherein the press covers are comprised of woven or non-woven cloth, and the press covers contain a fragrance which can be decomposed at high temperatures.

10. A hair iron comprising:

a first member having a hair heating surface on an interior surface thereof a second member having a pressing surface on an interior surface thereof, said first and second members joined at their ends via a joint member such that the members can be flexibly opened and closed to bring said hair heating surface and said pressing surface into and out of opposition;

a first removable, heat-resistant iron press cover to cover said hair heating surface; and a second removable, heat-resistant iron press cover to cover said pressing surface, wherein the press covers completely cover the ends of said members.

11. A method of styling hair using a hair iron, said hair iron comprising:

a first member having a hair heating surface on an interior surface thereof a second member having a pressing surface on an interior surface thereof said first and second members joined at their ends via a joint member such that the members can be flexibly opened and closed to bring said hair heating surface and said pressing surface into and out of opposition;

a first removable, heat-resistant iron press cover to cover said hair heating surface; and a second removable, heat-resistant iron press cover to cover said pressing surface, said method comprising:

placing said hair between the first and second heating surfaces and bringing said first and second surfaces into opposition, thereby sandwiching said hair between the hair heating surface and the pressing surface via said iron press covers; and washing the iron press covers after use for sanitary maintenance.

* * * * *